US011415374B2

(12) United States Patent
Kim et al.

(10) Patent No.: US 11,415,374 B2
(45) Date of Patent: Aug. 16, 2022

(54) HYBRID HEATING SYSTEM

(71) Applicant: LG Electronics Inc., Seoul (KR)

(72) Inventors: Minsoo Kim, Seoul (KR); Jihyeong Ryu, Seoul (KR); Youngmin Lee, Seoul (KR); Eunjun Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 359 days.

(21) Appl. No.: 16/660,372

(22) Filed: Oct. 22, 2019

(65) Prior Publication Data

US 2020/0124357 A1 Apr. 23, 2020

(30) Foreign Application Priority Data

Oct. 22, 2018 (KR) ..... 10-2018-0126195

(51) Int. Cl.

*F28D 21/00* (2006.01)
*F24H 1/38* (2022.01)
*F24H 6/00* (2022.01)

(52) U.S. Cl.

CPC ..... *F28D 21/0007* (2013.01); *F24H 1/38* (2013.01); *F24H 6/00* (2013.01); *F28D 21/0008* (2013.01)

(58) Field of Classification Search

CPC .... F28D 21/0007; F28D 21/0008; F24H 1/38; F24H 6/00

See application file for complete search history.

(56) References Cited

U.S. PATENT DOCUMENTS 9,127,866 B2 * 9/2015 Ben-Yaacov ..... F24D 19/1039
9,341,383 B2 * 5/2016 Aspeslagh ..... F24D 3/08
2010/0031953 A1 * 2/2010 Penev ..... F24D 19/106 126/615

(Continued)

FOREIGN PATENT DOCUMENTS

JP H07190526 7/1995
KR 20130130264 A * 12/2013

(Continued)

OTHER PUBLICATIONS

Kim, WO 2014/148704 A1 English machine translation, Sep. 25, 2014 (Year: 2014).*

(Continued)

*Primary Examiner* — Steven S Anderson, II
*Assistant Examiner* — Phillip Decker
(74) *Attorney, Agent, or Firm* — Fish & Richardson P.C.

(57) ABSTRACT

A hybrid heating system is disclosed. The hybrid heating system includes a compressor that is configured to compress refrigerant. The hybrid heating system further includes a first heat exchanger that is configured to adjust a temperature of water by exchanging heat between the water and refrigerant compressed by the compressor. The hybrid heating system further includes a second heat exchanger that is configured to evaporate refrigerant by exchanging heat exchange with exterior air. The hybrid heating system further includes a first boiler heat exchanger that is configured to increase a temperature of water using heat generated by combustion. The hybrid heating system further includes a second boiler heat exchanger that is configured to exchange heat between exhaust gas discharged from the first boiler heat exchanger and refrigerant flowing into the second heat exchanger.

8 Claims, 7 Drawing Sheets

(56) References Cited

U.S. PATENT DOCUMENTS

| | | | | |
|---|---|---|---|---|
| 2012/0248212 | A1* | 10/2012 | Storm | F24D 12/02 237/12 |
| 2013/0312436 | A1* | 11/2013 | Chen | F25B 47/025 62/81 |

FOREIGN PATENT DOCUMENTS

| | | |
|---|---|---|
| KR | 1020150043830 | 4/2015 |
| WO | WO2014/083440 | 6/2014 |
| WO | WO2014/148704 | 9/2014 |

OTHER PUBLICATIONS

KR 10-2015-0043830 A English machine translation, Apr. 23, 2015 (Year: 2015).*

Jang et al., KR 10-2013-0130264 A English machine translation, Feb. 12, 2013 (Year: 2013).*

EP Search Report in European Application No. EP19204572, dated Mar. 2, 2020, 9 pages.

* cited by examiner

HYBRID HEATING SYSTEM

CROSS-REFERENCE TO RELATED APPLICATION

This application claims the benefit of priority to Korean Application No. 10-2018-0126195, filed on Oct. 22, 2018, which is incorporated by reference.

FIELD

The present disclosure relates to a hybrid heating system and, more particularly, to a hybrid heating system that heats heating water using a heat pump and/or a boiler.

BACKGROUND

A boiler or a heat pump may be used to heat an interior.

A boiler is a device that heats an interior by heating water using combustion heat, which is generated when fuel is burned, and supplying the heated water having heat to a heating demander through heating pipes installed in the interior, and supplies the heated water as hot water for a bathroom, a kitchen, etc.

A heat pump can heat an interior by heating the heating water using heat, which is generated in the process of phase change of a refrigerant, and supplying the heated water to a heating demander.

SUMMARY

A boiler has an advantage that it is possible to temporarily provide a large amount of heating heat, but there is a problem that a lot of cost is required to use fuel. Further, the heat pump generates heat by circulating a refrigerant by driving a compressor, so a low cost may be required in comparison to the boiler, but there is a defect that it is impossible to provide sufficient heating heat at very low temperature.

Accordingly, a hybrid heating system that separately or simultaneously uses a heat pump and a boiler by complementing the advantages and defects of a boiler and a heat pump is being developed.

In a hybrid heating system, there is a need for a separate defrosting process to remove frost that may be produced in an second heat exchanger due to driving of a heat pump.

However, in the structure described above, a refrigerant discharged from a compressor is sent to the second heat exchanger by adjusting the flow direction of the refrigerant in order to perform a defrosting process. In this case, the flow direction of the refrigerant is changed, so heating has to be stopped. Accordingly, there the interior heating may be intermittently stopped.

A first object of the present disclosure is to provide a hybrid heating system that can perform a defrosting process without changing the flow direction of a refrigerant of a heat pump.

Through the first object, a second object of the present disclosure is to provide a hybrid heating system that does not stop a separate heating operation for a defrosting operation of an second heat exchanger.

A third object of the present disclosure is to provide a hybrid heating system in which hybrid heating efficiency by a heat pump and a boiler can be maintained even though a defrosting operation and a heating operation are simultaneously performed.

A fourth object of the present disclosure is to provide a hybrid heating system in which hybrid heating efficiency can be maintained by using heat that is used in existing boilers without introducing an additional heat source.

The objects of the present disclosure are not limited to the objects described above and other objects will be clearly understood by those skilled in the art from the following description.

According to an innovative aspect of the subject matter described in this application, a hybrid heating system includes a compressor that is configured to compress refrigerant; a first heat exchanger that is configured to adjust a temperature of water by exchanging heat between the water and refrigerant compressed by the compressor; a second heat exchanger that is configured to evaporate refrigerant by exchanging heat exchange with exterior air; a first boiler heat exchanger that is configured to increase a temperature of water using heat generated by combustion; and a second boiler heat exchanger that is configured to exchange heat between exhaust gas discharged from the first boiler heat exchanger and refrigerant flowing into the second heat exchanger.

This implementation and other implementations may each include one or more of the following optional features. The hybrid heating system includes an expansion valve that is configured to expand refrigerant discharged from the first heat exchanger. The second boiler heat exchanger is located between the expansion valve and the second heat exchanger. The second heat exchange is configured to adjust a temperature of refrigerant that is discharged from the second boiler heat exchanger and that flows to the compressor. A degree of opening/closing of the expansion valve is based on a degree of overheating of refrigerant flowing into the second heat exchanger through the second boiler heat exchanger.

The hybrid heating system includes a defrosting valve that provides refrigerant flowing in the first heat exchanger to the second heat exchanger or the second boiler heat exchanger. The defrosting valve is configured to provide refrigerant discharged from the first heat exchanger to the second boiler heat exchanger based on the first boiler heat exchanger increasing a temperature of water. The hybrid heating system includes a controller that is configured to control the defrosting valve. While the hybrid heating system operates in a hybrid heating mode that heats water using the first heat exchanger and the first boiler heat exchanger, the controller is configured to adjust the defrosting valve such that refrigerant discharged from the first heat exchanger flows to the second heat exchanger through the second boiler heat exchanger at regular intervals. The hybrid heating system includes an exterior temperature sensor that senses an exterior temperature.

Based on the exterior temperature being less than or equal to a set temperature, the controller is configured to adjust the defrosting valve such that refrigerant discharged from the first heat exchanger flows to the second heat exchanger through the second boiler heat exchanger. The hybrid heating system includes a first mode change valve that is configured to provide water that has passed through the first heat exchanger to a heating demander or the first boiler heat exchanger. The hybrid heating system includes a hot water supply heat exchanger that is configured to increase a temperature of water that is supplied to a user using heated water; and a second mode change valve that is configured to provide water heated through the first boiler heat exchanger to the hot water supply heat exchanger.

The details of other implementations are included in the following detailed description and the accompanying drawings.

DETAILED DESCRIPTION

Figure 1:
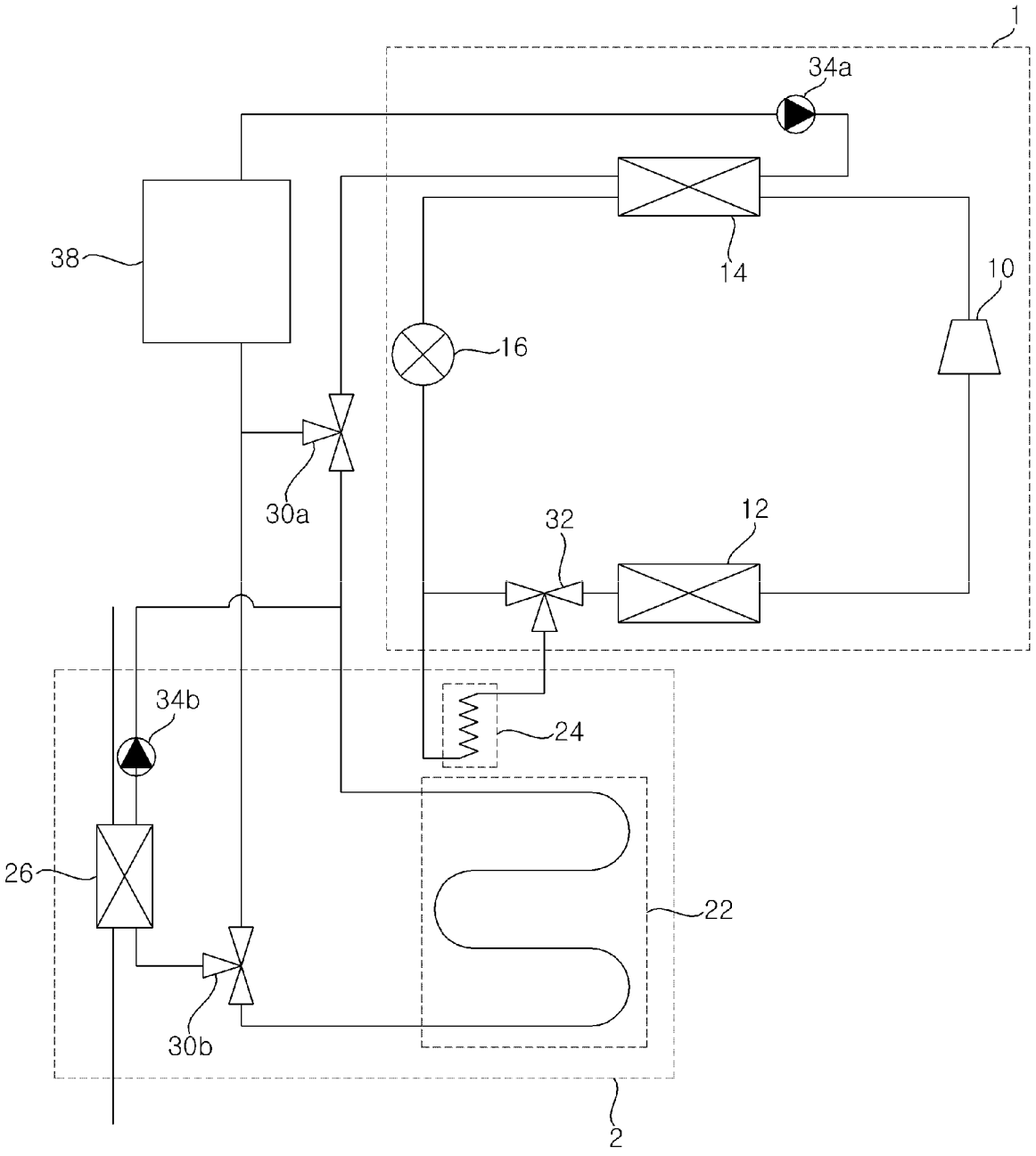
FIG. 1 is a schematic of an example hybrid heating system.

FIG. 1 is a schematic of an example hybrid heating system.

A hybrid heating system includes a heat pump 1 that heats heating water using heat exchange with a refrigerant, and a boiler 2 that heats the heating water using combustion heat. In this configuration, the heating water means water as an example of a medium for supplying heat to a target to be heated, and fluid other than water may be used. The heating water is a medium that flows through the boiler 2 or the heat pump 1 and is not discriminated from cold water or hot water.

The hybrid heating system can heat the heating water by operating the heat pump 1 or can heat the heating water by operating the boiler 2. Further, the hybrid heating system can heat the heating water by operating both of the heat pump 1 and the boiler 2.

The heat pump 1 includes a compressor 10 that compresses a refrigerant, an first heat exchanger 14 that heats heating water by condensing the compressed refrigerant, an expansion valve 16 that expands the condensed liquid-state refrigerant, and an second heat exchanger 12 that evaporates the expanded liquid-state refrigerant through heat exchange with external air.

The heat pump 1 includes a second boiler heat exchanger 24 that heats a refrigerant that is supplied to the second heat exchanger 12, and a defrosting valve 32 that selectively sends the refrigerant flowing through the expansion valve 16 to the second heat exchanger 12 or the second boiler heat exchanger 24.

The heat pump 1 may be a system that performs a one-way cycle that sends the refrigerant compressed through the compressor 10 to the first heat exchanger 14 and sends the refrigerant exchanging heat through the second heat exchanger 12 to the compressor 10.

That is, the refrigerant discharged from the compressor 10 may sequentially flow through the first heat exchanger 14 and the second heat exchanger 12 and then may flow back to the compressor 10 in the system. However, depending on adjustment by the defrosting valve 32, the refrigerant that has passed through the expansion valve 16 may flow to the compressor 10 through the second boiler heat exchanger 24 and the second heat exchanger 12, or may flow to the compressor through only the second heat exchanger 12 without passing through the second boiler heat exchanger 24.

The compressor 10 discharges a high-temperature and high-pressure refrigerant by compressing a refrigerant gas and may use a BLDC motor.

A plate heat exchanger that allows for heat exchange between heating water and a refrigerant may be used as the first heat exchanger 14. The first heat exchanger 14 is used as a condenser and can heat heating water using heat that is generated by condensation of a refrigerant.

The second heat exchanger 12 allows for heat exchange between external air and a refrigerant. The second heat exchanger 12 may be used as an evaporator that evaporates a refrigerant through heat exchange with external air.

However, in a defrosting-heating mode to be described below, a refrigerant that has passed through the second boiler heat exchanger 24 can be supplied to the second heat exchanger 12. The refrigerant flowing in the second heat exchanger 12 is a refrigerant heated through the second boiler heat exchanger 24, whereby a defrosting operation of the external heat exchanger 12 is possible. In the defrosting-heating mode for removing frost in the second heat exchanger 12, the second heat exchanger 12 can adjust the degree of overheating of the refrigerant flowing into the compressor 10. The second heat exchanger 12 can decrease the temperature of an overheated refrigerant and can adjust the degree of overheating by adjusting the expansion valve 16. The degree of opening/closing of the expansion valve 16 can be adjusted in consideration of the degree of overheating of the refrigerant flowing into the second heat exchanger 12 through the second boiler heat exchanger 24.

The boiler 2 can heat heating water that is supplied to a heating demander 38 using combustion heat. The combustion heat means heat that is generated by combustion of fuel and the fuel that is used in the boiler may include fossil fuel such as gas.

That is, the boiler 2 can heat heating water using combustion heat that is generated by heating fuel that is supplied to the boiler 2.

The boiler 2 may include a first boiler heat exchanger 22 that heats heating water using combustion heat and a second boiler heat exchanger 24 that allows for heat exchange between exhaust gas discharged from the first boiler heat exchanger 22 and the refrigerant flowing through the heat pump 1.

The first boiler heat exchanger 22 heats heating water using combustion heat. That is, heat that is generated by combustion of fuel is supplied to heating water.

The second boiler heat exchanger 24 allows for heat exchange between exhaust gas discharged from the first boiler heat exchanger 22 and a refrigerant. The second boiler heat exchanger 24 may be used as an evaporator that evaporates a refrigerant using the heat of the exhaust gas discharged from the first boiler heat exchanger 22. A high-temperature refrigerant discharged from the second boiler heat exchanger 24 flows into the second heat exchanger 12, thereby being able to defrost the second heat exchanger 12.

The hybrid heating system may further include a hot water supply heat exchanger 26 that heats hot water that is supplied to a user. The hot water supply heat exchanger 26 can heat hot water by allowing for heat exchange between the hot water and the heating water heated by the boiler 2.

The hybrid heating system includes a mode change valves 30*a* and 30*b* that adjust operation modes of the system.

The mode change valves 30*a* and 30*b* include a first mode change valve 30*a* that selectively sends the heating water that has passed through the first heat exchanger 14 to the heating demander 38 or the boiler 2.

The hybrid heating system can operate in a boiler heating mode in which heating water is heated by operating only the boiler, a heat pump heating mode in which heating water is heated by operating only the heat pump 1, and a hybrid heating mode in which heat water is heated by operating both of the heat pump 1 and the boiler 2.

The first mode change valve 30*a* supplies heating water discharged from the heating demander to the boiler 2 in the boiler heating mode and the hybrid heating mode. The first mode change valve 30*a* can supply the heating water that has passed through the first heat exchanger 14 to the heating demander 38 in the heat pump heating mode.

The first mode change valve 30*a* may be a 3-way valve that has one inlet and two outlets and discharges heating water flowing inside through the one inlet to at least one of the two outlets.

The mode change valves 30*a* and 30*b* include a second mode change valve 30*b* that supplies some of the heating water heated by the boiler 2 to the hot water supply heat exchanger 26. The second mode change valve 30*b* can supply some of the heating water heated by the boiler 2 to the hot water supply heat exchanger 26 in a hot water supply mode that supplies hot water to a user.

The hybrid heating system includes a defrosting valve 32 that adjusts a channel such that a refrigerant that is supplied to the second heat exchanger 12 passes through the second boiler heat exchanger 24 when the second heat exchanger 12 is frosted by exterior cold air.

The defrosting valve 32 can send the refrigerant discharged from the second heat exchanger 12 to the first heat exchanger 14 or can send the refrigerant to the first heat exchanger 14 through the second boiler heat exchanger 24. The defrosting valve 32 sends the refrigerant discharged from the first heat exchanger 12 to the second boiler heat exchanger 24 when exterior temperature is a predetermined temperature or less.

The defrosting valve 32 sends the refrigerant discharged from the first heat exchanger 12 to the second boiler heat exchanger 24 when the boiler 2 is operated. That is, the defrosting valve 32 sends the refrigerant discharged from the first heat exchanger 12 to the second boiler heat exchanger 24 when the first boiler heat exchanger 22 heats heating water.

The defrosting valve 32 may be a 3-way valve that has one inlet and two outlets and selectively connects the one inlet to one of the two outlets. The defrosting valve 32 sends a refrigerant to the second boiler heat exchanger 24 in the defrosting-heating mode that defrosts the second heat exchanger 12 that has been frosted.

The hybrid heating system includes pumps 34*a* and 34*b* that generate flow of heating water that flows through the heat pump 1 or the boiler 2. The pumps 34*a* and 34*b* may include a first pump 34*a* that is disposed upstream further than the first heat exchanger 14 to generate flow of heating water that flows to the first heat exchanger 14, and a second pump 34*b* that generates flow of heating water when heating water is supplied to the hot water supply heat exchanger 26.

Figure 2:
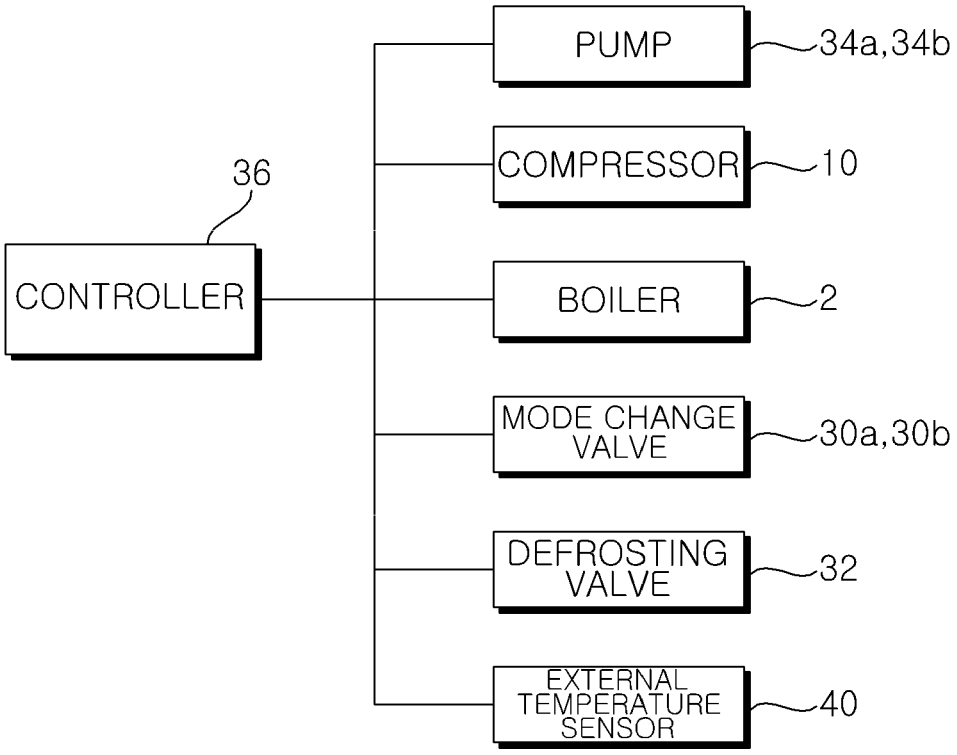
FIG. 2 is a block diagram of an example controller and relevant components.

FIG. 2 is a block diagram of an example controller and relevant components.

The hybrid heating system includes a controller 36 that adjusts the mode change valves 30*a* and 30*b* or controls operation of the heat pump 1 and the boiler 2 in accordance with the operation modes.

The controller 36 can adjust the first mode change valve 30*a* in accordance with the operation modes of the hybrid heating system. The controller 36 can adjust the operation of the boiler 2 and the compressor 10 in accordance with the operation modes of the hybrid heating system. The controller 36 can adjust the second mode change valve 30*b* in accordance with the operation modes of the hybrid heating system.

The hybrid heating system may further include an exterior temperature sensor 40 that finds out exterior temperature. The controller 36 can adjust the first mode change valve 30*a*, the boiler 2, and the compressor 10 in accordance with exterior temperature found out by the exterior temperature sensor 40.

The controller 36 can adjust the defrosting valve 32. The controller 36 can adjust the defrosting valve 32 on the basis of exterior temperature found out on the basis of the exterior temperature sensor 40.

The controller 36 can perform the defrosting-heating mode with regular intervals in the hybrid heating mode that operates both of the heat pump 1 and the boiler 2 at a predetermined temperature or less. That is, in the hybrid heating mode in which the refrigerant discharged from the first heat exchanger 14 flows to the second heat exchanger 12, the controller 36 can make the refrigerant discharged from the first heat exchanger 14 flow to the second heat exchanger 12 through the second boiler heat exchanger 24 by controlling the defrosting valve 32 with regular intervals.

Figure 3:
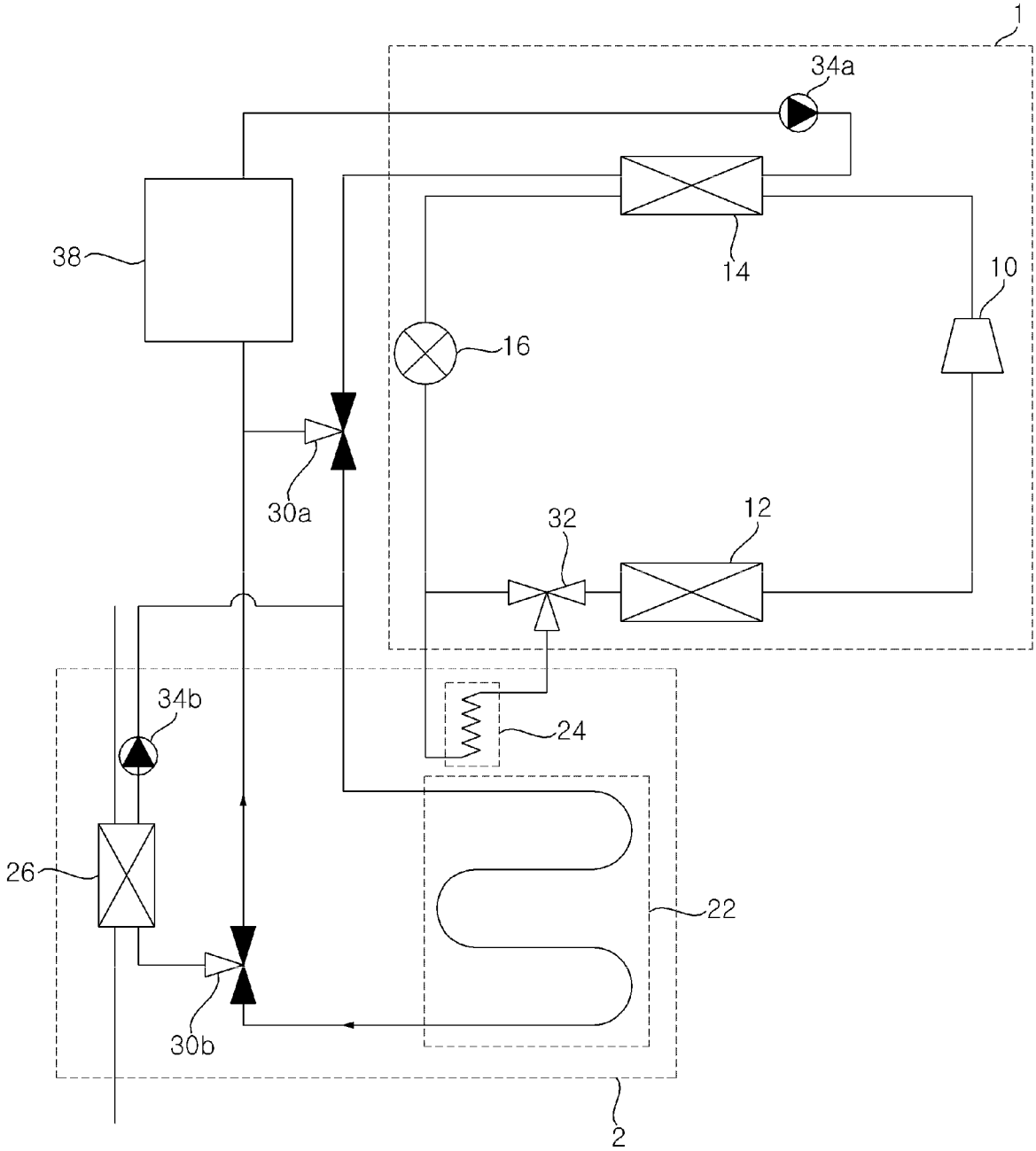
FIG. 3 illustrates water flow when an example hybrid heating system is in a boiler heating mode.
Figure 4:
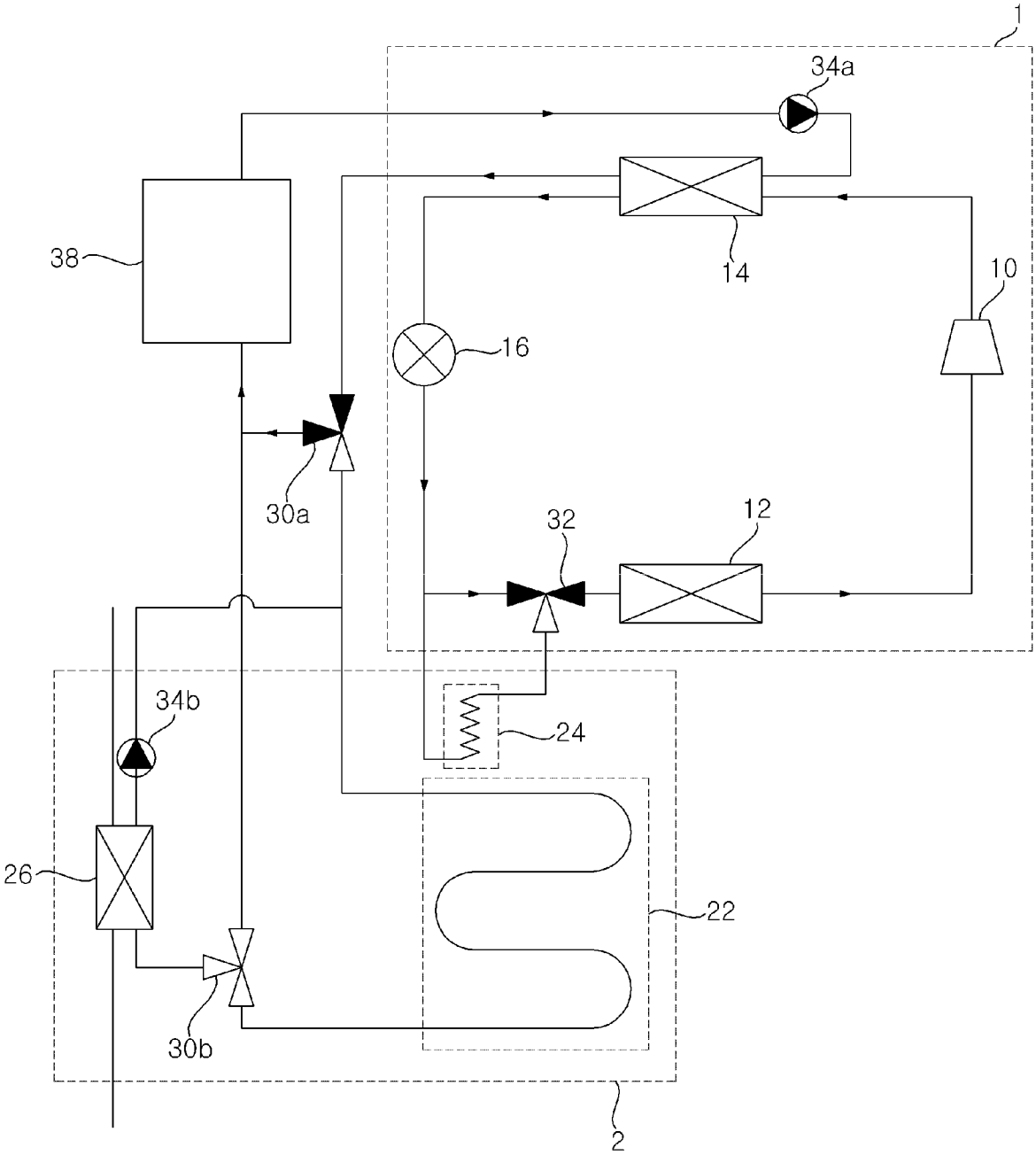
FIG. 4 illustrates water flow when an example hybrid heating system is in a heat pump heating mode.
Figure 5:
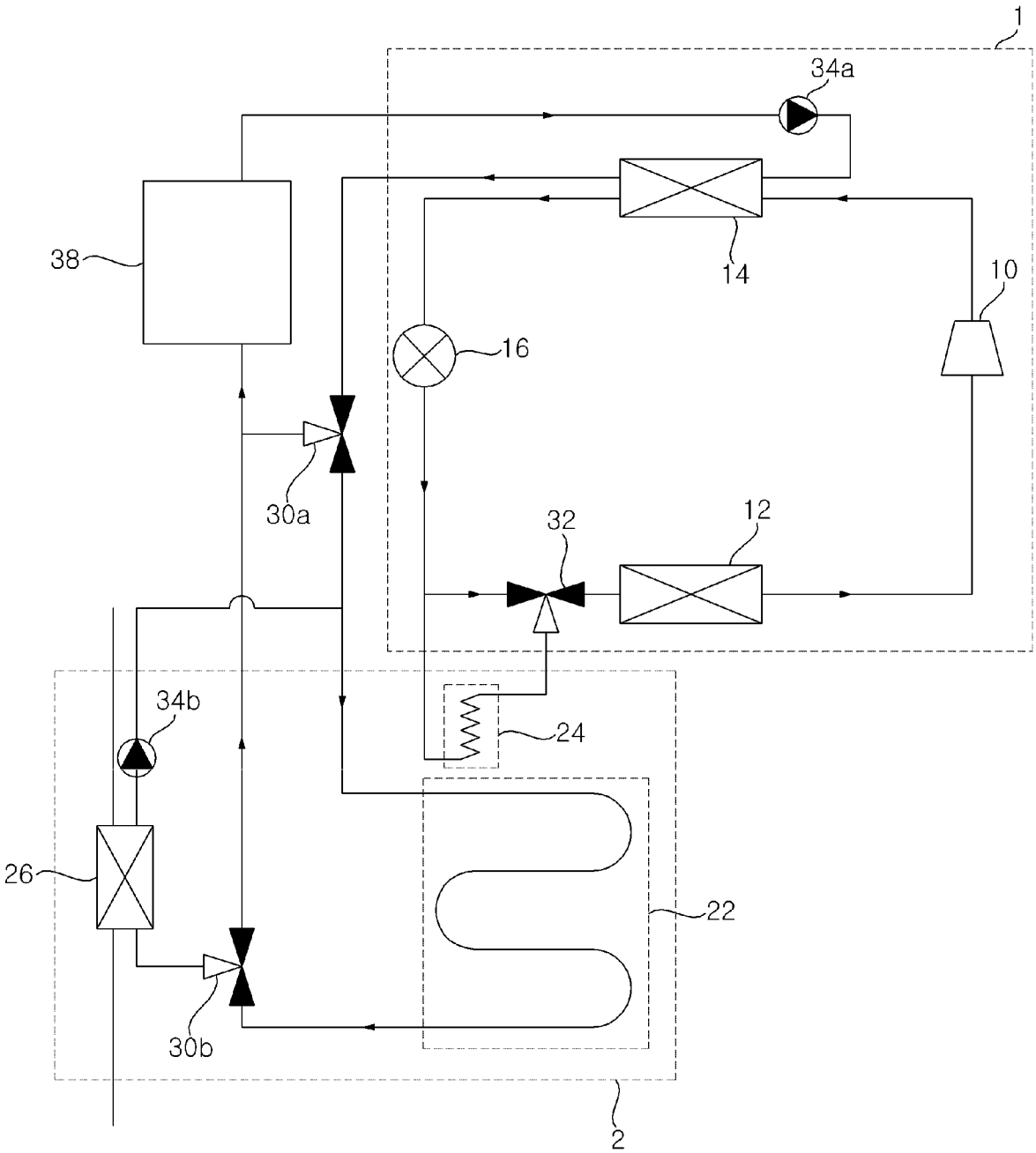
FIG. 5 illustrates water flow when an example hybrid heating system is in a hybrid heating mode.
Figure 6:
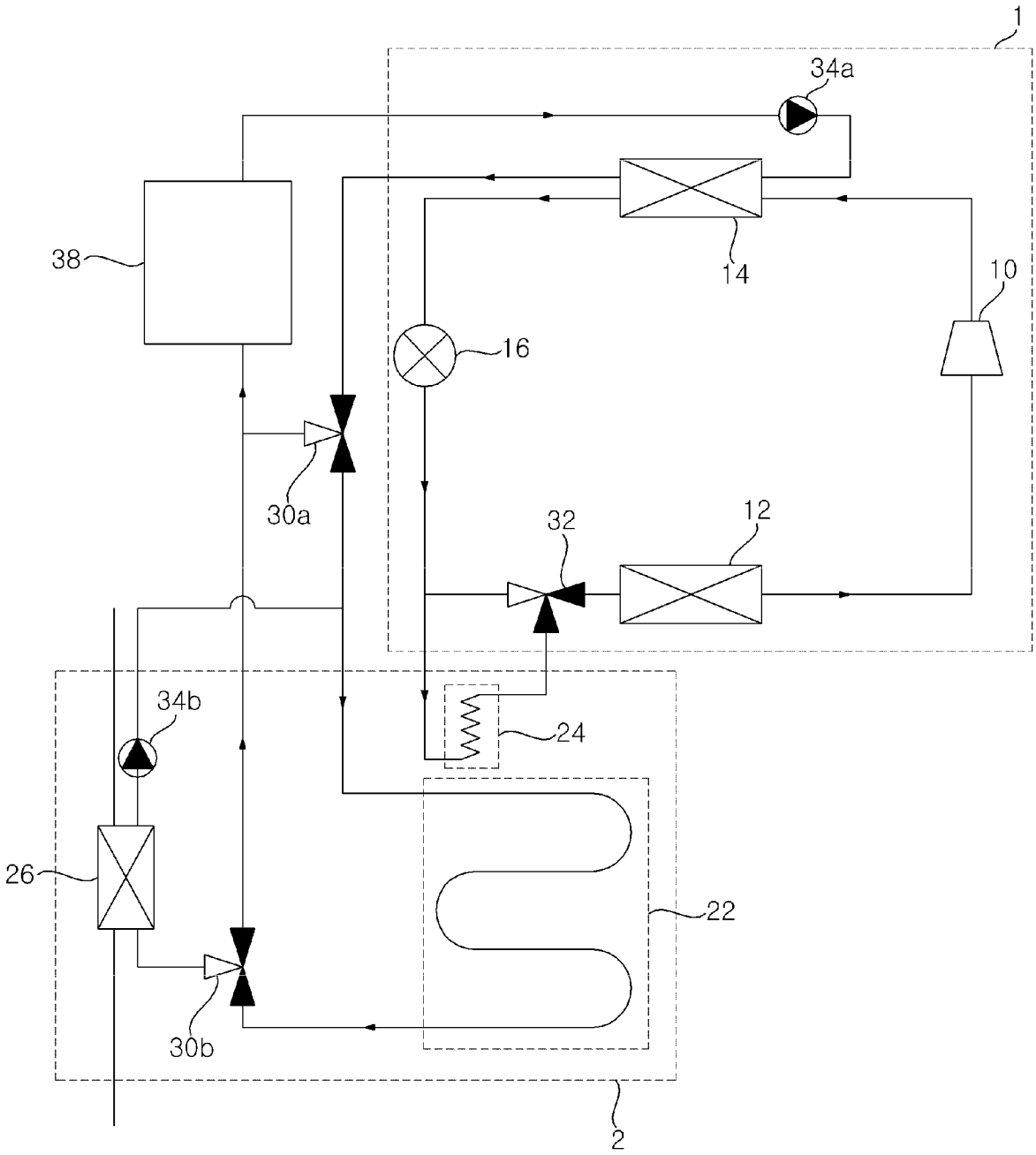
FIG. 6 illustrates water flow when an example hybrid heating system in a dehumidifying-heating mode.

FIG. 3 illustrates heating water flow when the example hybrid heating system of FIG. 1 is in a boiler heating mode. FIG. 4 illustrates heating water flow when the example hybrid heating system of FIG. 1 is in a heat pump heating mode. FIG. 5 illustrates heating water flow when the example hybrid heating system of FIG. 1 is in a hybrid heating mode. FIG. 6 illustrates heating water flow when the example hybrid heating system of FIG. 1 is in a dehumidifying-heating mode.

The hybrid heating system can heat heating water by operating only the boiler, can heat heating water by operating only the heat pump 1, or can heat heating water by operating both of the heat pump 1 and the boiler 2, depending on the operation modes.

The operation modes may be change in accordance with exterior temperature. That is, at a first set temperature or more measured by the exterior temperature sensor 40, the heat pump heating mode that heats heating water by operating only the heat pump can be performed. Further, when exterior temperature is less than the first set temperature and equal to or higher than a second set temperature, the hybrid heating mode that heats heating water using both of the heat pump 1 and the boiler 2 can be performed. Further, when the exterior temperature is less than the second set temperature, the boiler heating mode that heats heating water by operating only the boiler can be performed.

The hybrid heating system can provide hot water to a user by performing a hot water supply mode. The hot water supply mode can be separately performed in each mode. When the hot water supply mode is performed, some of heated heating water can be sent to the hot water supply heat exchanger 26. Further, when the hot water supply mode is performed, it is possible to heat heating water by operating the boiler. In this case, the boiler 2 can be additionally operated in the mode in which the boiler 2 is not operated.

Further, the hybrid heating system can defrost the second heat exchanger that has been used as an evaporator and defrosted, by performing the defrosting-heating mode. In the hybrid heating system, the direction of the refrigerant flowing in the heat pump 1 is not changed to the opposite direction in the defrosting-heating mode.

In the boiler heating mode of the hybrid heating system, the heat pump 1 may not be operated.

In the boiler heating mode, heating water is heated by operating the boiler 2. The heating water heated by the boiler 2 can be supplied to the heating demander 38.

In the boiler heating mode, the compressor is not separately operated. In the boiler heating mode, the first mode change valve 30*a* supplies the heating water flowing through the heating demander to the boiler 2. In the boiler heating mode, the heating water that has passed through the first heat exchanger 14 can be supplied to the boiler 2. However, since the compressor 10 is not operated in the boiler heating mode, specific heat exchange is not generated even though heating water passes through the first heat exchanger 14.

The hot water supply mode can be performed even in the boiler heating mode. When the hot water supply mode is performed, some of the heating water heated by the boiler can be supplied to the hot water supply heat exchanger 26 by adjusting the second mode change valve 30*b*.

In the heat pump heating mode, the compressor is operated, so a refrigerant exchanges heat with heating water or exterior air while flowing. That is, in the heat pump heating mode, the first heat exchanger is used as a condenser. The heating water flowing into the first heat exchanger 14 through the heating demander can be heated by exchanging heat with the refrigerant through the first heat exchanger 14 that is used as a condenser.

The first mode change valve 30*a* may be supplied such that the heating water that has passed through the first heat exchanger 14 is supplied to the heating demander 38 in the heat pump heating mode. In the heat pump heating mode, the defrosting valve 32 may be disposed such that the refrigerant discharged from the first heat exchanger 14 is supplied to the second heat exchanger 12. That is, the refrigerant discharged from the first heat exchanger 14 can be supplied to the second heat exchanger 12 without specifically passing through the second boiler heat exchanger 24.

In the heat pump heating mode, the boiler 2 is not operated. However, when the hot water supply mode is performed even in this case, it is possible to heat and supply some of heating water to the hot water supply heat exchanger 26 by operating the boiler 2.

In the hybrid heating mode, heating water can be primarily heated through the first heat exchanger 14 of the heat pump 1 and can be secondarily heated through the boiler 2. In the hybrid heating mode, the heat pump 1 including the compressor 10 is operated and the boiler 2 is operated, thereby heating the heating water.

The controller 36 can adjust the first mode change valve 30*a* such that the heating water that has passed through the first heat exchanger 14 is supplied to the boiler 2 in the hybrid heating mode. Accordingly, the heating water primarily heated through the first heat exchanger 14 can be secondarily heated through the boiler 2.

In the hybrid heating mode, the second heat exchanger 12 performs the function of an evaporator. In this case, the second heat exchanger 12 may be frosted when exterior temperature is a predetermined temperature or less.

In the defrosting-heating mode, the refrigerant flowing in the heat pump 1 does not flow backward. Accordingly, in the hybrid heating system, it is possible to heat heating water by operating the heat pump 1 even in the defrosting-heating mode.

In the defrosting-heating mode, the defrosting valve 32 is adjusted such that the refrigerant that has passed through the expansion valve 16 flows to the second heat exchanger 12 through the second boiler heat exchanger 24. That is, the defrosting valve 32 connects the second boiler heat exchanger 24 and the second heat exchanger 12.

In the defrosting-heating mode, the refrigerant heated through the second boiler heat exchanger 24 is supplied to the second heat exchanger 12, whereby the second heat exchanger 12 can be defrosted.

In the defrosting-heating mode, the second heat exchanger 12 decreases the temperature of the refrigerant overheated through the second boiler heat exchanger 24. In the defrosting-heating mode, the controller 36 can adjust the degree of overheating of the refrigerant flowing into the second heat exchanger 12 by adjusting the expansion valve 16.

Figure 7:
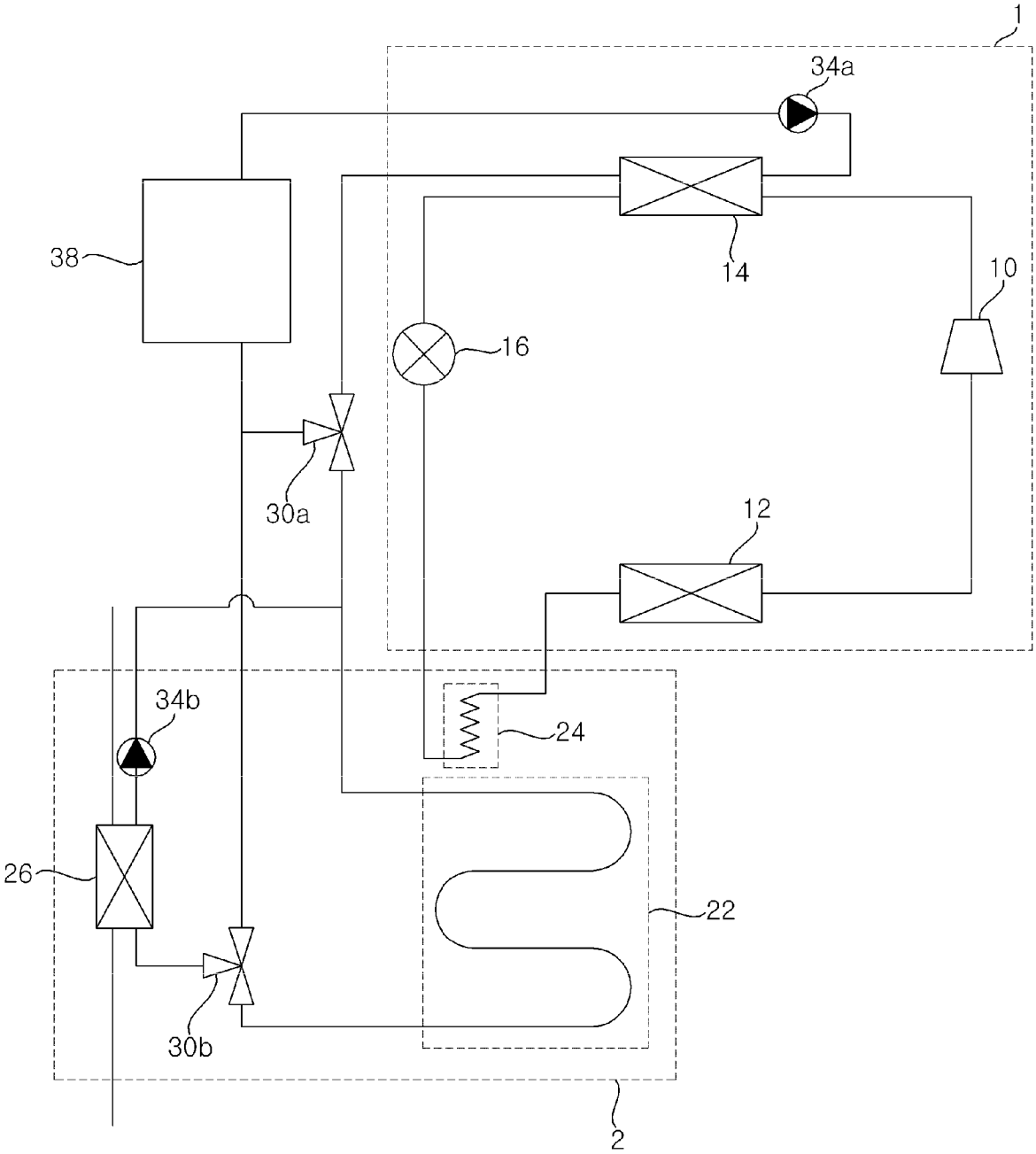
FIG. 7 is a schematic an example hybrid heating system.

FIG. 7 illustrates an example hybrid heating system.

Hereafter, a hybrid heating system is described mainly on the basis of the difference from the hybrid heating system according to FIG. 1.

A hybrid heating system includes a heat pump 1 that heats heating water by exchanging heat with a refrigerant, and a boiler 2 that heats the heating water using combustion heat.

The heat pump 1 includes a compressor 10 that compresses a refrigerant, an first heat exchanger 14 that heats heating water by condensing the compressed refrigerant, an expansion valve 16 that expands the condensed liquid-state refrigerant, an second heat exchanger 12 that evaporates the expanded liquid-state refrigerant through heat exchange with external air, and a second boiler heat exchanger 24 that heats a refrigerant that is supplied to the second heat exchanger 12.

The heat pump 1 does not include a separate defrosting valve 32. Accordingly, when a refrigerant flows in the heat pump 1 by driving of the compressor 10, the refrigerant necessarily passes through the second boiler heat exchanger 24.

In a hybrid heating mode that is performed at temperature is less than a first set temperature and is equal to or lower than a second set temperature, the heated refrigerant that has passed through the second boiler heat exchanger 24 is supplied to the second heat exchanger 12 in the hybrid heating system. In the hybrid heating system, the second heat exchanger 12 is not frosted in the hybrid heating mode. Accordingly, the hybrid heating system does not need a specific defrosting-heating mode.

In the hybrid heating mode, the hybrid heating system decreases the temperature of the refrigerant flowing into the second heat exchanger 12 by adjusting the expansion valve 16.

According to a hybrid heating system of the present disclosure, one or more effects can be achieved as follows.

First, the subject matter described in the present disclosure can perform a defrosting operation without changing the channel direction of a heat pump cycle. Accordingly, there is an advantage of saving costs because there is no need for a specific switch valve.

Second, the subject matter described in the present disclosure can continuously perform heating without stopping due to a defrosting operation in a heating operation, so there is also an advantage that it is possible to make a user feel pleasant.

Third, the subject matter described in the present disclosure can perform a hybrid heating operation by a heat pump and a boiler even in a defrosting operation, so there is also an advantage that heating efficiency can be maintained even in the defrosting operation.

Further, the subject matter described in the present disclosure can perform defrosting simultaneously with additional heating, using the heat of an exhaust gas from a boiler, so there is also an advantage that the cost required for using a separate heat source.

What is claimed is:

1. A hybrid heating system comprising:

a compressor that is configured to compress refrigerant;

a first heat exchanger that is configured to adjust a temperature of water by exchanging heat between the water and refrigerant compressed by the compressor;

a second heat exchanger that is configured to evaporate refrigerant by exchanging heat exchange with exterior air;

a first boiler heat exchanger that is configured to increase a temperature of water using heat generated by combustion;

a second boiler heat exchanger that is configured to exchange heat between exhaust gas discharged from the first boiler heat exchanger and refrigerant flowing into the second heat exchanger;

a defrosting valve that provides refrigerant flowing in the first heat exchanger to the second heat exchanger or the second boiler heat exchanger; and a controller that is configured to control the defrosting valve, wherein, while the hybrid heating system operates in a hybrid heating mode that heats water using the first heat exchanger and the first boiler heat exchanger, the controller is configured to adjust the defrosting valve such that refrigerant discharged from the first heat exchanger flows to the second heat exchanger through the second boiler heat exchanger at regular intervals.

2. The hybrid heating system of claim 1, comprising:

an expansion valve that is configured to expand refrigerant discharged from the first heat exchanger, wherein the second boiler heat exchanger is located between the expansion valve and the second heat exchanger.

3. The hybrid heating system of claim 2, wherein the second heat exchanger is configured to adjust a temperature of refrigerant that is discharged from the second boiler heat exchanger and that flows to the compressor.

4. The hybrid heating system of claim 3, wherein a degree of opening/closing of the expansion valve is based on a degree of overheating of refrigerant flowing into the second heat exchanger through the second boiler heat exchanger.

5. The hybrid heating system of claim 1, wherein the defrosting valve is configured to provide refrigerant discharged from the first heat exchanger to the second boiler heat exchanger based on the first boiler heat exchanger increasing a temperature of water.

6. The hybrid heating system of claim 1, comprising:

an exterior temperature sensor that senses an exterior temperature, wherein, based on the exterior temperature being less than or equal to a set temperature, the controller is configured to adjust the defrosting valve such that refrigerant discharged from the first heat exchanger flows to the second heat exchanger through the second boiler heat exchanger.

7. The hybrid heating system of claim 1, comprising:

a first mode change valve that is configured to provide water that has passed through the first heat exchanger to a heating demander or the first boiler heat exchanger.

8. The hybrid heating system of claim 7, comprising:

a hot water supply heat exchanger that is configured to increase a temperature of water that is supplied to a user using heated water; and a second mode change valve that is configured to provide water heated through the first boiler heat exchanger to the hot water supply heat exchanger.

* * * * *